United States Patent [19]

Lever

[11] Patent Number: 4,461,430

[45] Date of Patent: Jul. 24, 1984

[54] DIFFERENTIAL WINDING AIR SHAFT

[76] Inventor: Louis Lever, 162 Wayfair Cir., Wyckoff, N.J. 07581

[21] Appl. No.: 471,001

[22] Filed: Mar. 1, 1983

[51] Int. Cl.[3] ..... B65H 19/04; B65H 75/24

[52] U.S. Cl. ..... 242/56.9; 242/72 B

[58] Field of Search ..... 242/56.9, 72 B, 72 R, 242/68.2, 46.2, 46.4, 46.5, 46.6; 279/2 R, 2 A

[56] References Cited

U.S. PATENT DOCUMENTS

| | | | |
|---|---|---|---|
| 2,950,071 | 8/1960 | Tidland | 242/72 B |
| 3,010,671 | 11/1961 | Brown | 242/56.9 |
| 3,048,345 | 8/1962 | Willard | 242/72 B |
| 3,391,878 | 7/1968 | Naccara | 242/72 B |
| 3,702,687 | 11/1972 | Hall | 242/56.9 |
| 3,817,468 | 6/1974 | Smolderen et al. | 242/56.9 |
| 3,853,280 | 12/1974 | Pennisi et al. | 242/56.9 |
| 3,863,857 | 2/1975 | Smith | 242/72 B |
| 3,904,144 | 9/1975 | Gattrugeri | 242/72 B |
| 3,945,583 | 3/1976 | Ochs et al. | 242/56.9 |
| 4,026,488 | 5/1977 | Hashimoto | 242/72 B |
| 4,026,491 | 5/1977 | Bostroem | 242/56.9 X |
| 4,209,138 | 6/1980 | Cecchi | 242/56.9 |
| 4,218,029 | 8/1980 | Schwenzfeier et al. | 242/56.9 |
| 4,220,291 | 9/1980 | Papa | 242/72 B |
| 4,266,737 | 5/1981 | Mastriani | 242/56.9 X |
| 4,342,433 | 8/1982 | Mastriani | 242/56.9 X |

OTHER PUBLICATIONS

Daven Industries Inc., Leaf Style Shaft, Undated two-page Flier.

Daven Industries Inc., Maintenance, Undated two-page Flier.

*Primary Examiner*—Stanley N. Gilreath

*Attorney, Agent, or Firm*—Kenyon & Kenyon

[57] ABSTRACT

A pneumatically expandable mandrel for winding multiple strips of web material on a plurality of cores spaced axially on the mandrel includes a shaft having a hollow tubular portion. Each core is supported by a separate group of flanged arcuate shells angularly spaced around the periphery of the tubular portion of the shaft, each shell being mounted on a stem that extends through a corresponding opening in the tubular wall and has an enlarged foot that is spring biased against a rubber tube extending through the center of the tubular portion of the shaft. Inflation of the rubber tube expands the shells of each group into contact with a respective core.

11 Claims, 4 Drawing Figures

DIFFERENTIAL WINDING AIR SHAFT

BACKGROUND OF THE INVENTION

1. Field of the Invention

This invention relates to pneumatically operated expandable winding mandrels, or air shafts, and particularly to air shafts for differentially winding multiple webs simultaneously.

2. Description of the Prior Art

Expandable mandrels are commonly used for winding rolls of web material such as films, foils, and tapes onto cores. After a core, or several cores, is positioned on a mandrel, the mandrel is expanded by a pressurized fluid, usually compressed air, to engage the inside of the core. The pressure is adjusted so that the core will not slip on the mandrel unless a predetermined web tension is exceeded.

Pneumatically actuated expandable mandrels, called air shafts in the industry, typically have one or more thin-walled cylindrical segments, or leaves, fitted around the circumference of a support shaft. The leaves are held to the shaft by spring loaded fasteners that allow the leaves to be urged radially outward upon inflation of one or more resilient tubes extending along the length of the shaft. Alternatively, rows of axially-spaced spring loaded buttons extending the length of the support shaft may be used instead of continuous leaves.

In some designs, there is an inflatable tube provided for each leaf or row of buttons, each tube being disposed in a corresponding longitudinal groove in the outer surface of a support shaft. A simpler arrangement is to provide a single rubber tube in the center of a hollow support shaft. Examples of the latter type of air shaft are shown in U.S. Pat. No. 3,391,878 of N. G. Naccara and also are manufactured by Daven Industries, Inc., the assignee of the present invention.

A common application of air expandable shafts relates to converting wide rolls of web material into multiple narrow strips. The process involves unwinding a wide web from a single long core, slitting the web into narrow strips, and rewinding the strips simultaneously on corresponding narrow cores. Usually, the multiple strips are rewound on two parallel mandrels, each mandrel carrying equally spaced cores for winding alternative strips of the slit web.

Although leaf-type air shafts can be used for multiple core winding in some instances, they do not produce satisfactory results in web converting operations. Due to minor variation in core diameters and web thickness, the several strips will not rewind evenly unless equal tension is maintained in each strip as it rewinds. This requires that the cores be able to slip differentially with respect to each other on the same shaft. It is also important that the cores not move axially on the shaft during winding; otherwise the edges of the rewound strips will not lie precisely in two parallel planes perpendicular to the axis of the core. Air shafts having leaves that extend the full length of the support shaft do not provide the necessary individual slip control for each core and do not prevent the cores from shifting axially.

Consequently, air shafts intended for differential winding of multiple cores customarily have separate axially-spaced expansion members for engaging each core. An example of such a differential winding mandrel is shown in U.S. Pat. No. 3,853,280 of J. V. Pennisi, et al. The Pennisi mandrel has a single row of shouldered arcuate members on one side of a mandrel body. Although relatively simple in design, this arrangement is unsymmetrical and would tend to expand the cores into an out-of-round condition. Also, the mandrel body does not have equal bending stiffness in all radial directions, which could lead to wobble or whip during winding.

Other types of differential winding mandrels are shown in U.S. Pat. No. 4,266,737 of E. A. Mastriani, 4,026,491 of T. Bostroem, 3,817,468 of A. E. Smoldeen, et al., 3,904,144 of G. Gattrugeri, 3,552,672 of K. E. L. Grettve and 4,026,488 of K. Hashimoto. These other types are also relatively complicated, have multiple inflatable members, or have other drawbacks.

SUMMARY OF THE INVENTION

It is a principal object of the present invention to provide a differential winding air shaft for multiple cores that has a high bending strength relative to its length and diameter and that provides uniform support to individual cores around a major part of its circumference.

Another object of the invention is to provide a multiple core differential winding air shaft that is simple in construction, inexpensive to manufacture, and easy to disassemble for maintenance and repair.

Still another object of the invention is to provide a multiple core differential winding air shaft that has a minimum number of different parts, to reduce the cost of spare parts inventory.

These and other objects are achieved in a differential winding mandrel comprising:

an elongated hollow shaft having a tubular wall portion with a cylindrical outer surface, a plurality of axially spaced circumferential grooves in said outer surface, and a plurality of circumferentially spaced openings extending through the tubular wall in each groove, each opening in one groove being axially aligned with a corresponding opening in each other groove;

a plurality of core engaging means disposed in circumferentially spaced relation in each groove, each core engaging means comprising an arcuate core engaging outer surface and a stem extending radially inward through a corresponding one of the openings through the wall of the hollow shaft, the stem having an enlarged inner end;

spring means disposed between an inner surface of the tubular wall and the enlarged inner end of each stem for biasing the stem radially inward;

a single elongated expandable elastomeric tube extending substantially coaxially within the hollow shaft; and means for introducing fluid under pressure into said elastomeric tube for expanding the tube to exert an outward force against the inner ends of the stems of the core engaging means for moving said core engaging means radially outward.

A preferred embodiment of the differential winding mandrel further comprises a plurality of land means extending longitudinally between every circumferentially adjacent core engaging means, each land means having an outer surface defining part of a cylinder having a diameter greater than that of the outer surface of the shaft and of the outermost surface of the core engaging means when the elastomeric tube is unpressurized.

The above and other objects, features, and advantages of the invention will be more apparent from the following detailed description, taken in conjunction with the drawings.

DETAILED DESCRIPTION OF THE PREFERRED EMBODIMENT

Figure 1:
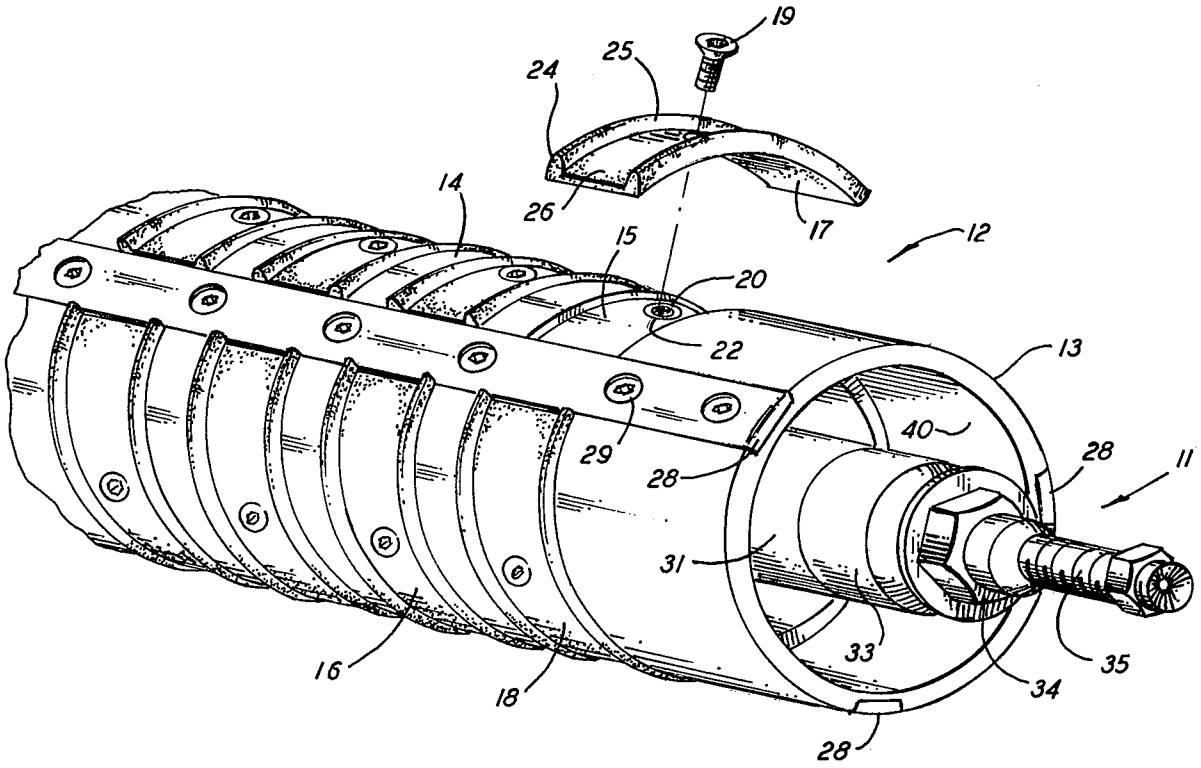
FIG. 1 is a perspective view of a partially assembled differential winding expandable mandrel according to the invention.

With reference to the drawings, a differential winding expandable mandrel or air shaft 11 includes an elongated hollow shaft 12 having a tubular wall portion 13 with a cylindrical outer surface 14. A series of axially spaced circumferential grooves 15 interrupt the cylindrical outer surface 14 along the length of the tubular wall. Each groove contains a plurality of core engaging means 16, each core engaging means including a shell 17 having an arcuate core engaging outer surface 18. The shell is attached by a screw 19 to the outer end of a stud 20 having a stem 21 that extends radially through an opening 22 in the tubular wall portion. The stud has an enlarged flat head 23 at its inner end.

In the embodiment illustrated there are three identical core engaging means associated with each groove 15 in the outer surface of the tubular wall portion. More core engaging means could be used, if desired, for relatively large diameter mandrels, and as few as two are possible.

Each shell 17 is in the form of a thin-walled cylindrical segment having external flanges 24 along each circumferential edge. The inner side wall 25 of each flange 24 preferably tapers inwardly to meet a cylindrical surface portion 26 so as to provide positive axial positioning of a corresponding cylindrical winding core 27 when the mandrel is in the expanding condition. Preferably the junction between each tapered side wall 25 and the cylindrical surface portion 26 is relieved by a concave groove **26*a*. Typically, the winding cores are cut to width from a tubular blank by slicing knives or similar means and are left with a burr on the inner edge. Groove 26*a* accommodates such a burr so that the core will not bind on the shells 17**.

A feature of the illustrated embodiment is that the arcuate extent of each shell 17 is substantially less than one-third of a circle (i.e., 120 degrees), although it should preferably be not less than approximately 75 degrees. The openings 22 in each groove are equally spaced circumferentially and are aligned longitudinally with corresponding openings in the other grooves to form rows of axially spaced openings. Thus, the ends of adjacent shells in each groove are spaced circumferentially, preferably by approximately half the angular extent of the shells.

The angular gaps between circumferentially adjacent shells are occupied by longitudinally extending bars 28 that are fastened to the tubular wall portion 13 by screws 29, which preferably are interchangeable with the screws 19 for fastening the shells to their respective stems. The outer surface of each longitudinal bar is arcuate in cross section and is defined by a cylinder coaxial with the tubular wall portion and having a diameter slightly greater than that of the cylindrical outer surface 14 of the tubular portion. The longitudinal bars thereby define an outer circumference of the hollow shaft.

The core engaging shells 17 are biased inwardly into contact with the corresponding grooves 15 by leaf springs 30 disposed between the enlarged heads of the studs 20 and the interior surface of the tubular wall portion 13. Each leaf spring is formed from a sheet of spring steel having a central hole large enough to accommodate the stem of a stud. In place of the leaf springs 30, it may be desirable to use coil springs for biasing the shells radially inward. Preferably, spiral coil springs are used, with the small diameter end of the coil bearing against the head 23 of the corresponding stud and the large diameter end of the coil bearing against the inner surface of the tubular shaft 12. The spiral-wound springs have the advantage that they can be compressed flat, and placement of the larger end of the coil against the inner wall of the shaft assures that the spring will not enter the corresponding opening 22.

When biased inwardly to the retracted position, the outermost surfaces of the shells 17 are within the cylindrical envelope defined by the outer surfaces of the longitudinal bars 28. The bars can thus serve as axial lands to facilitate assembly of multiple cores on the mandrel. The longitudinal bars also enhance the stiffness and bending strength of the mandrel since they act as axial tensile and compression members disposed at the greatest possible distance from the neutral axis of the mandrel.

An elongated elastomeric tube 31 extends substantially coaxially within the tubular portion of the hollow shaft. One end of the tube is closed by a solid tube plug 32 held in place by an end cap 33, a jam nut 34, and a lock washer (not shown). The other end of the tube is provided with an air entry pipe 35 that leads to a check valve (not shown) or other means for permitting connection of the entry pipe to a source of compressed air.

Figure 3:
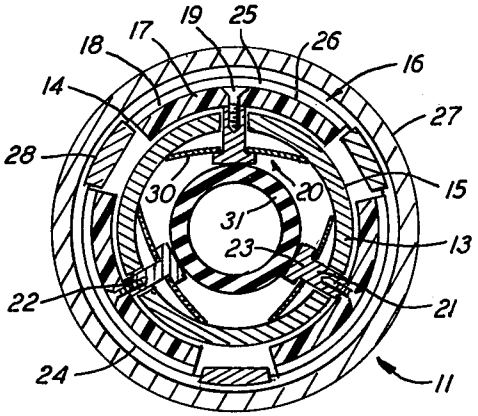
FIG. 3 is a cross-section view taken along the line III—III of FIG. 2, with the mandrel unexpanded.

The outside diameter of the unpressurized tube is small enough so that the tube can be inserted into the tubular portion past the inner ends of the studs 20, when the shells are in the retracted position, as best shown in FIG. 3.

Figure 2:
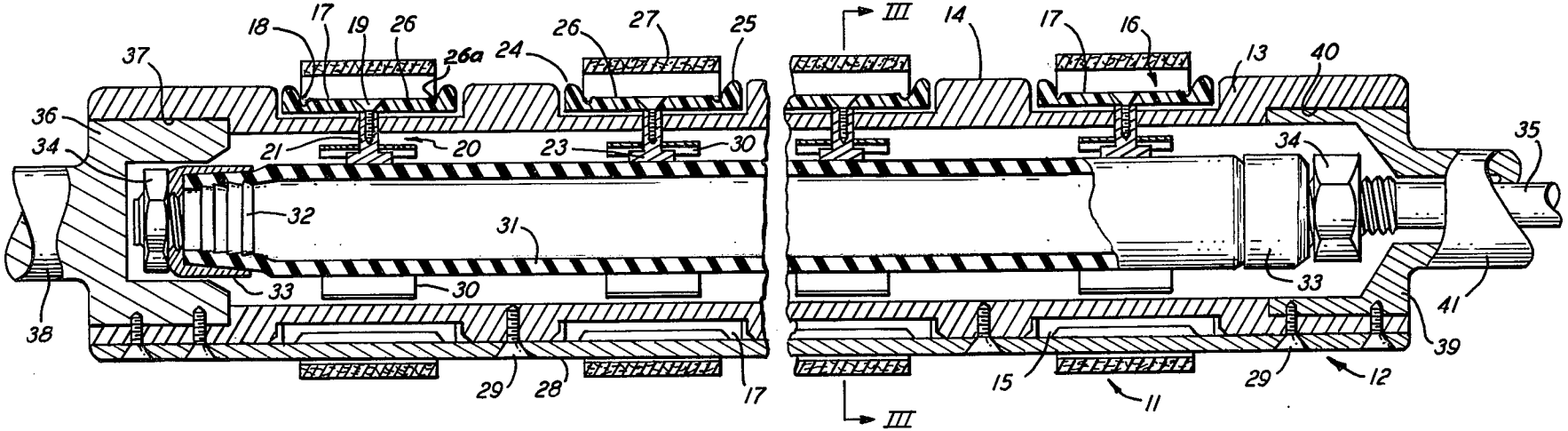
FIG. 2 is an elevation view in cross-section of the mandrel of FIG. 1.

The hollow shaft 12 is completed by a solid plug 36 that fits within a counterbore 37 in one end of the tubular portion and has a coaxial journal 38 extending outwardly therefrom. A similar hollow plug 39 fits within a counterbore 40 in the other end of the tubular shaft and has a hollow coaxial journal 41 extending outwardly therefrom. The two end journal plugs 36 and 39 are held in place by the endmost screws 29 that fasten each of the longitudinal bars to the shaft, as shown in FIG. 2.

The method of operation of the differential winding shaft is conventional and well known to those of skill in the art. Briefly, the desired number of cores is first assembled on the mandrel. This is most conveniently done by use of a core box, which is basically a semi-cylindrical open-ended trough having shallow annular grooves spaced along its length at intervals equal to the axial spacing of the core engaging shells on the mandrel. A core is set in each of the grooves of the trough, and then the mandrel is slid along the bottom of the trough through the aligned cores, the longitudinal bars 28 serving as skids so that the outer circumferences of the tubular portion 13 and the shells 17 do not contact the core box or the cores or otherwise interfere with sliding the mandrel into the box.

Figure 4:
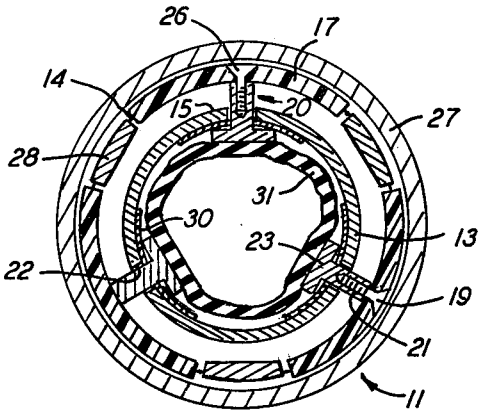
FIG. 4 is a cross-section view similar to FIG. 3, but with the mandrel expanded.

After the mandrel is in position relative to the cores, the air entry pipe of the elastomeric tube is connected to a source of compressed air, causing the tube to expand and press against the heads of the studs, forcing them outward until the shells engage the inner circumferences of the corresponding cores, as shown in FIG. 4, to a required slip fit for differential winding. If the air pipe is equipped with a check valve, the air source can be disconnected, and the mandrel will remain in the expanded condition. It can then be lifted out of the core box and placed in a winding machine with the end journals rotatably supported in bearings, ready for the winding operation.

From the foregoing description and the drawings, it will be apparent that the differential winding air shaft or mandrel of the present invention has a number of features and advantages. First of all, it is simple. Excluding the rubber hose assembly and the screws, there are only seven different parts required. All of the parts can be fabricated by relatively simple machining operations.

Secondly, the design has an inherently high bending strength because the tubular portion of the shaft is close to the maximum diameter of the unexpanded mandrel, and the longitudinal bars compensate for strength lost by the annular grooves in the outer surface of the tubular portion. These grooves are shallow, in any event, because they need only to accommodate the shells, which can be relatively thin since the external flanges 24 along each circumferential edge of the shells provide stiffness as well as an axial locating function for the cores.

The shells can be made of a suitable thermosetting plastic material, such as a phenolic material, or they can be made out of metal, such as aluminum. A particularly effective material is aluminum that has been surface coated or impregnated with a fluorocarbon plastic such as polytetrafluoroethylene. The various parts of the hollow shaft can be made of steel, for strength, or aluminum, for light weight. The elastomeric tube is preferably a length of rubber air hose.

It will be apparent also that many variations in the arrangement and construction of the mandrel are possible without departing from the scope of the invention. For example, the tubular portion can be an assembly of spaced rings fitted onto a plain cylindrical tube to create the annular grooves for the core engaging means. Coil springs can be substituted for leaf springs, and other substitutions of equivalent parts can be made, as would occur to the skilled mechanic.

I claim:

1. A differential winding mandrel for simultaneously winding a plurality of web strips onto cylindrical cores, said mandrel comprising:

a shaft comprising a wall defining a hollow portion along a substantial part of the length of the shaft, the wall having a plurality of rows of axially spaced openings through it, corresponding openings in each row lying in a plane perpendicular to the axis of the shaft;

a plurality of core supports in each of the planes, each core support comprising an arcuate shell disposed externally of the shaft and having a part cylindrical core-engaging outer surface portion, means extending outwardly beyond the part cylindrical outer surface portion of the shell to engage the edges of a respective core supported thereon to prevent axial movement of the core during winding of a web strip on the core, an inwardly extending stem movably disposed in a corresponding one of the openings in the wall of the shaft, and an enlarged foot on the inner end of the stem;

biasing means disposed between the foot of each stem and the inner surface of the shaft wall for urging the stem radially inward; and an elongated, expandable, elastomeric tube extending substantially coaxially within the hollow shaft and comprising means to allow fluid to be forced into the tube to expand the tube radially against the feet of the core supports to force the arcuate shells outwardly, whereby the core supports in each of the planes can frictionally engage angularly extensive portions of the inner surface of one core to provide tangential drive of that core independently of other cores on the core supports in others of the planes.

2. The mandrel of claim 1 in which there are three of the core supports in each of the planes, and the arcuate shells of each of the core supports extends over an arc of at least 75 degrees.

3. The mandrel of claim 1 in which the outer surface of the wall of the shaft comprises portions extending outwardly between adjacent openings in each of the rows.

4. The mandrel of claim 1 in which the outer surface of the wall of the shaft comprises recesses to receive the arcuate shells of the core supports and to hold the axes of the arcuate shells substantially parallel to the axis of the shaft, the outer surface of the wall comprising radially outermost regions extending farther from the axis of the shaft when the tube is not expanded than do the outermost surfaces of the cylindrical outer surface portions, the length of each of the stems being sufficient to permit the respective core support to be moved outwardly far enough, when the tube is expanded, to carry the means extending outwardly therefrom to a location farther from the axis of the shaft than any part of the radially outermost regions of the wall of the shaft.

5. The mandrel of claim 1 in which the means extending outwardly comprises a pair of flanges at the axial end of each of the arcuate shells, the distance between the pair of flanges being substantially equal to the axial length of the core to be supported on that core support.

6. The mandrel of claim 5 in which the flanges include sloping surface portions facing the substantially cylindrical outer surface portion between them to engage corner regions at the axial ends of a core, the intersections between the sloping surface portions and the cylindrical outer surface portion being formed by undercut circumferential grooves.

7. The mandrel of claim 1 in which the arcuate shell of each of the core supports is a phenolic member.

8. The mandrel of claim 1 in which the arcuate shell of each of the core supports is aluminum.

9. The mandrel of claim 8 in which the aluminum is impregnated with a fluorinated hydrocarbon.

10. The mandrel of claim 1 in which the resilient means comprises a leaf spring with an aperture through it, the leaf spring being threaded on the respective stem and comprising edge portions engaging the inner surface of the wall of the shaft.

11. The mandrel of claim 1 in which the axial length of each of the substantially cylindrical outer surface portions of the shells is not substantially greater than the distance between proximal axial ends of the cylindrical outer surface portions of axially adjacent core supports.

* * * * *